United States Patent [19]

Groves

[11] Patent Number: 4,744,410

[45] Date of Patent: May 17, 1988

[54] HEAT TRANSFER ELEMENT ASSEMBLY

[75] Inventor: James A. Groves, Wellsville, N.Y.

[73] Assignee: The Air Preheater Company, Inc., Wellsville, N.Y.

[21] Appl. No.: 17,954

[22] Filed: Feb. 24, 1987

[51] Int. Cl.[4] ..... F23D 19/00

[52] U.S. Cl. ..... 165/10; 165/8

[58] Field of Search ..... 165/10, 8

[56] References Cited

U.S. PATENT DOCUMENTS 4,396,058 8/1983 Kurschner et al. ..... 165/10

FOREIGN PATENT DOCUMENTS 525154 5/1956 Canada ..... 165/10

*Primary Examiner*—Albert W. Davis, Jr.

*Attorney, Agent, or Firm*—William W. Habelt

[57] ABSTRACT

A rotary regenerative heat exchanger (2) for transferring heat from a hot fluid to a cold fluid by means of an assembly (30) of heat transfer element which is alternately contacted with the hot and cold fluid. The heat transfer element assembly (30) is comprised of a plurality heat transfer plates (32) stacked alternately in spaced relationship. The spacing between adjacent plates (32) is maintained by spacers which comprise notches in the form of bilobed folds crimped in the plates (32) at spaced intervals to prevent nesting between adjacent plates, the pitch of the sloping web portions (60) of not more than half of the bilobed folds (38B) in each plate (30) will be opposite in inclination to the pitch of the sloping web portions (60) of at least half of the bilobed folds (38A) in the plates (30).

14 Claims, 2 Drawing Sheets

HEAT TRANSFER ELEMENT ASSEMBLY

BACKGROUND OF THE INVENTION

The present invention relates to heat transfer element and, more specifically, to an assembly of heat absorbent plates for use in a heat exchanger wherein heat is transferred by means of the plates from a hot heat exchange fluid to a cold heat exchange fluid. More particularly, the present invention relates to an assembly of heat exchange element adapted for use in a heat transfer apparatus of the rotary regenerative type wherein the heat transfer element is heated by contact with the hot gaseous heat exchange fluid and thereafter brought in contact with a cool gaseous heat exchange fluid to which the heat transfer element gives up its heat.

One type of heat exchange apparatus to which the present invention has particular application is the well-known rotary regenerative heater. A typical rotary regenerative heater has a cylindrical rotor divided into compartments in which are disposed and supported spaced heat transfer plates which as the rotor turns are alternately exposed to a stream of heating gas and then upon further rotation of the rotor to a stream of cooler air or other gaseous fluid to be heated. As the heat transfer plates are exposed to the heating gas, they absorb heat therefrom and then when exposed to the cool air or other gaseous fluid to be heated, the heat absorbed from the heating gas by the heat transfer plates is transferred to the cooler gas. Most heat exchangers of this type have their heat transfer plates closely stacked in spaced relationship to provide a plurality of passageways between adjacent plates for flowing the heat exchange fluid therebetween.

In such a heat exchanger, the heat transfer capability of a heat exchanger of a given size is a function of the rate of heat transfer between the heat exchange fluid and the plate structure. However for commercial devices, the utility of a device is determined not alone by the coefficient of heat transfer obtained, but also by other factors such as the resistance to flow of the heat exchange fluid through the device, i.e., the pressure drop, the ease of cleaning the flow passages, the structural integrity of the heat transfer plates, as well as factors such as cost and weight of the plate structure. Ideally, the heat transfer plates will induce a highly turbulent flow through the passages therebetween in order to increase heat transfer from the heat exchange fluid to the plates while at the same time providing relatively low resistance to flow between the passages and also presenting a surface configuration which is readily cleanable.

To clean the heat transfer plates, it has been customary to provide soot blowers which deliver a blast of high pressure air or steam through the passages between the stacked heat transfer plates to dislodge any particulate deposits from the surface thereof and carry them away leaving a relatively clean surface. Many plate structures have been evolved in attempts to obtain cleanable structures with adequate heat transfer. See for example the following U.S. Pat. Nos.: 1,823,481; 2,023,965; 2,438,851; 2,983,486; and 3,463,222.

One problem encountered with this method of cleaning is that the force of the high pressure blowing medium on the relatively thin heat transfer plates can lead to cracking of the plates unless a certain amount of structural rigidity is designed into the stack assembly of heat transfer plates. One solution to this problem is presented in U.S. Pat. No. 2,596,642. As disclosed therein individual heat transfer plates are crimped at frequent intervals to provide double-lobed notches which have one lobe extending away from the plate in one direction and the other lobe extending away from the plate in the opposite direction. Then when the plates are stacked together to form the heat transfer element, these notches serve not only to maintain adjacent plates at their proper distance from each other, but also to provide support between adjacent plates so that forces placed on the plates during the soot blowing operation can be equilibrated between the various plates making up the heat transfer element assembly.

However, in a heat transfer element assembly comprised of a plurality of like notched plates in a stacked array, the potential exists for the notches of adjacent plates to nest. That is, the notches may all become superimposed on one another so that the spacing between adjacent plates is lost and the adjacent plates touch along their entire length or a significant portion thereof. This may occur from improper installation or movement of the plates relative to each other during normal operation or during the soot blowing procedure. In any case, this nesting should be avoided as fluid flow between adjacent plates is prevented when the plates become nested.

In U.S. Pat. No. 4,396,058, an assembly of heat transfer element for a rotary regenerative heat exchanger is provided wherein nesting of adjacent sheets is precluded. As disclosed therein, the heat transfer element assembly comprises a plurality of first and second heat absorbent plates stacked alternately in spaced relationship thereby providing a plurality of passageways between adjacent first and second plates for the flowing of a heat exchange fluid therebetween with spacers formed in the plate to extend between the plates to maintain a predetermined distance between adjacent plates. The spacers comprise bilobed folds in the first and second plates. To preclude nesting, the folds in the first plates have their first lobe projecting outwardly therefrom in a first direction and their second lobe projecting outwardly therefrom in a second direction which is opposite to the first direction, while the folds in the second plates have their first lobe projecting outwardly thereform in the second direction and their second lobe projecting outwardly therefrom in the first direction. Thus, the folds in the second plate have a pitch which is opposite to the pitch of the folds in the first plate. Because the folds of adjacent plates are opposite in pitch, there is no way that the folds of adjacent plates can become superimposed. Unfortunately, assembling such an array of heat transfer element is labor intensive and, therefore, such an array is significantly more expensive to manufacture than an array of like-notched sheets.

It is, therefore, an object of the present invention to provide an improved heat transfer element assembly wherein the structural integrity of the heat transfer plates is enhanced by crimping the plates with notches designed to preclude nesting, while at the same time providing a heat transfer element assembly the plates of which are relatively simple to manufacture and easy to assembly in a stacked array.

SUMMARY OF THE INVENTION

To the fulfillment of this object and other objects which will be evident from the description presented herein, the heat transfer assembly of the present invention comprises a plurality of notched heat transfer plates stacked in spaced relationship thereby providing a plurality of passageways between adjacent plates for the flowing of a heat exchange fluid therebetween. Notches are crimped in the plates at spaced intervals in the form of bi-lobed folds which extend across the plate parallel to the direction on flow over the plate. The lobes of the notches form spacers extending between adjacent plates to maintain a predetermined separation distance between adjacent plates.

Each bilobed fold comprises a notch having a first lobe projectingly outwardly from the plate in a first direction, a second lobe projection outwardly from the plate in a second direction which is opposite to the first direction, and a sloping web portion extending intermediate the peaks of the first and second lobes of the fold. In accordance with the present invention, at least one of the bilobed folds in each plate of the assembly will have a web portion which is reversed to extend transversely to the sloping web portions of the remainder of the folds in the plate. Ergo, the pitch of the sloping web portions of not more than half of the bilobed folds in each plate will be opposite in inclination to the pitch of the sloping web portions of at least half of the bilobed folds in the plate.

DESCRIPTION OF A PREFERRED EMBODIMENT

Figure 1:
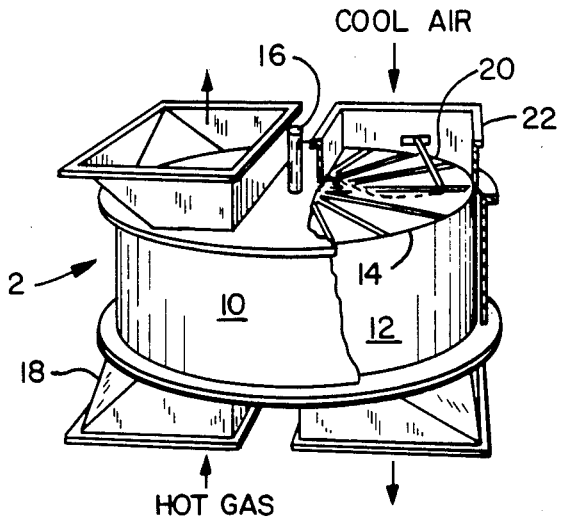
FIG. 1 is a perspective view of a rotary regenerative heat exchanger.

Referring now to the drawing and more particularly to FIG. 1, there is depicted therein a regenerative heat exchange apparatus 2 in which the heat transfer element assembly of the present invention may be utilized. The regenerative heat exchanger 2 comprises a housing 10 enclosing a rotor 12 wherein the heat transfer element assembly of the present invention is carried. The rotor 12 comprises a cylindrical shell 14 connected by radially extending partitions to the rotor post 16. A heating fluid enters the housing 10 through duct 18 while the fluid to be heated enters the housing 10 from the opposite end through duct 22.

The rotor 12 is turned about its axis by a motor connected to the rotor post 16 through suitable reduction gearing, not illustrated here. As the rotor 12 rotates, the heat transfer plates carried therein are first moved in contact with the heating fluid entering the housing through duct 18 to absorb heat therefrom and then into contact with the fluid to be heated entering the housing through duct 22. As the heating fluid passes over the heat transfer plates, the heat transfer plates absorb heat therefrom. As the fluid to be heated subsequently passes over the heat transfer plates, the fluid absorbs from the heat transfer plates the heat which the plates had picked up when in contact with the heating fluid.

As illustrated in FIG. 1, the regenerative heat exchanger 2 is often utilized as an air preheater wherein the heat absorbent element serves to transfer heat from hot flue gases generated in a fossil fuel-fired furnace to ambient air being supplied to the furnace as combustion air as a means of preheating the combustion air and raising overall combustion efficiency. Very often, the flue gas leaving the furnace is laden with particulate generated during the combusion process. This particulate has a tendency to deposit on the heat transfer plates particularly at the cold end of the heat exchanger where condensation of any moisture in the flue gas may occur.

In order to provide for periodic cleaning of the heat transfer element assembly, the heat exchanger is provided with a cleaning nozzle 20 disposed in the passage for the fluid to be heated adjacent the cold end of the rotor 12 and opposite the open end of the heat transfer element assembly. The cleaning nozzle 20 directs a high pressure cleaning fluid, typically steam, water, or air, through the plates as they rotate slowly while the nozzle itself sweeps across the end face of the rotor. As the high pressure fluid passes through the spaced heat transfer plates, turbulence in the fluid stream causes the heat transfer plates to vibrate so as to jar loose fly ash and other particulate deposits clinging thereto. The loosened particulate is then entrained in the high pressure fluid stream and carried out of the rotor.

Figure 2:
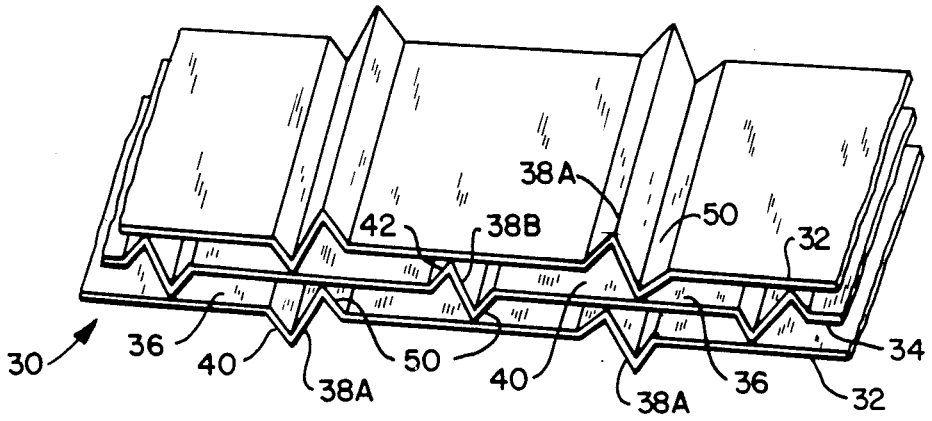
FIG. 2 is an enlarged perspective view of one embodiment of a heat transfer element assembly designed in accordance with the present invention.
Figure 3:
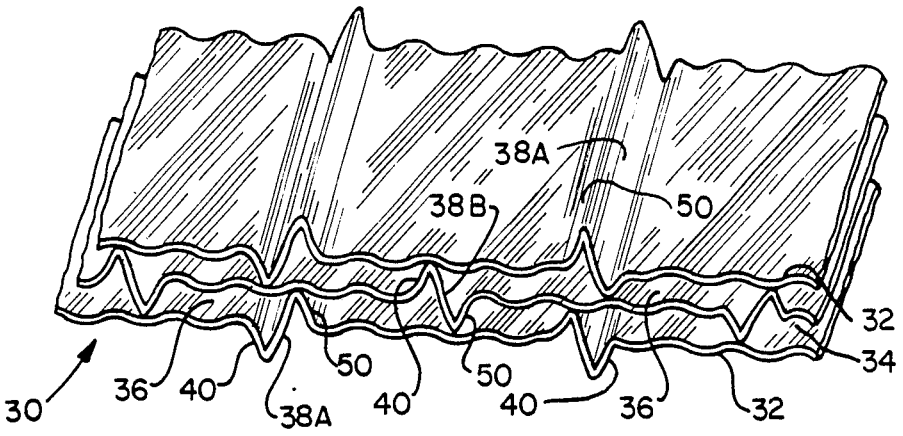
FIG. 3 is an enlarged perspective view of an alternate embodiment of a heat transfer element assembly designed in accordance with the present invention.
Figure 4:
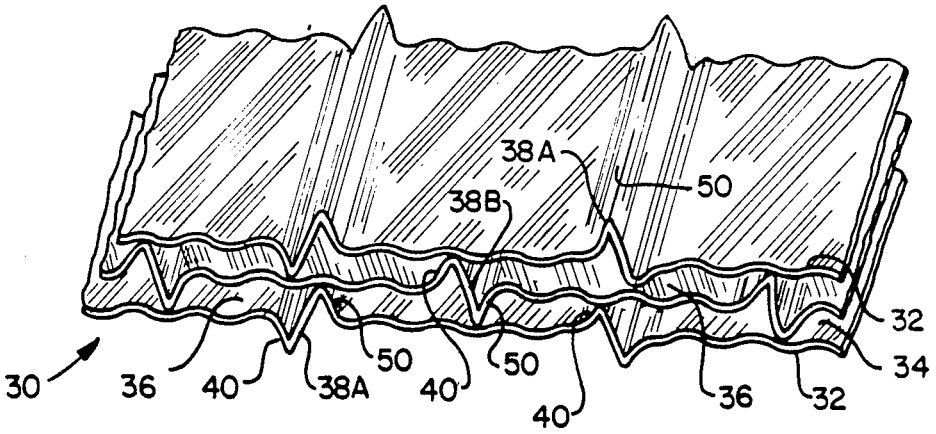
FIG. 4 is an enlarged perspective view of an additional alternate embodiment of a heat transfer element assembly designed in accordance with the present invention.

Referring now to FIGS. 2, 3, and 4, there is depicted therein three alternate embodiments of the heat transfer element assembly 30 designed in accordance with the present invention. As shown therein, each heat transfer element assembly is comprised of a plurality of heat transfer plates 32 stacked alternately in spaced relationship thereby providing a plurality of passageways therebetween. These passageways 36 provide a flow path for flowing a heat exchange fluid therebetween in heat exchange relationship with the plates. Notches 38A, 38B are formed in the plates 32 to provide spacers to maintain adjacent plates a predetermined distance apart and keep flow passages 36 open.

The plates 32 are usually of thin sheet metal capable of being rolled or stamped to the desired configuration, however, the invention is not necessarily limited to use of metallic plates. The plates 32 may be of various surface configurations such as, but not limited to, a flat surface as illustrated in FIG. 2 or, preferably, a corrugated surface as illustrated in FIGS. 3 or 4. Corrugated plates provide a series of oblique furrows which are relatively shallow as compared to the distance between adjacent plates. Typically, the furrows are inclined at an acute angle to the flow of heat exchanger fluid over the plates as illustrated in FIGS. 3 and 4. The corrugations of adjacent plates may extend obliquely to the line of flow of heat exchange fluid between the plates in aligned manner as shown in FIG. 3 or, if desire, oppositely to each other as shown in FIG. 4.

The notches 38A and 38B are formed by crimping the plates 32 to produce bilobed folds in the plates at spaced intervals. The bilobed folds 38A, 38B have first and second lobes, 40 and 50, respectively, projecting outwardly from the surface of the plate in opposite directions and a sloping web portion 60 extending between the outermost surfaces 34, commonly referred to as ridges or peaks or apexs, of the lobes 40 and 50. Typically, each lobe 40, 50 is in the form of a substantially V-shaped or U-shaped lobe directed outwardly from the plate with the ridge 34 of the lobe contacting the adjacent plate of the assembly. Additionally, it is preferred that the folds 38A and 38B are aligned parallel to the direction of flow through the element assembly so that flow will be along the lobes so that the lobes do not offer a significant resistance to fluid flow through the element assembly and do not interfere with the passage of the high pressure flowing medium between plates during cleaning.

The notches 38A and 38B in the heat transfer plates 32 are opposite in pitch. That is, each fold 38A in the plates 32 has its first lobe 40 projecting outwardly from the plate in a first direction and its second lobe 50 projecting outwardly from the plate in a second direction which is opposite to the first direction. At the same time, each fold 38B in the plates 32 has its first lobe 40 projecting outwardly from the plate in the second direction and its second lobe 50 projecting outwardly from the plate in the first direction, which is opposite to the second direction. Thus the web portion 60 of each of the folds 38B in the plates 32 will have a pitch, i.e. an inclination, which is opposite or transverse to the pitch of the web portions 60 of each of the folds 38A in the plates 32.

In order to prevent adjacent plates from nesting, each of the plates 32 has at least one bilobed fold 38B which will have a sloping web portion extending transversely to the sloping web portion of the folds 38A in the plate. A first portion of the notches in each of the plates 32 of the heat transfer assembly 30 of the present invention constituting at least half of the toal number of notches in the plate will comprise bilobed folds 38A, while a second portion of the notches in each of the plates 32 of the heat transfer assembly 30 of the present invention constituting not more than half of the total number of notches in the plate will comprise bilobed folds 38B which, as explained hereinbefore, will have a web portion 60 having a pitch opposite to the pitch of the web portion 60 of the bilobed folds 38A.

Because each of the folds 38B in the plates 32 will have a web portion 60 that extends transversely to the web portion 60 of each of the folds 38A in the plates 32, nesting between adjacent plates in the assembly of the present invention will not occur even if the notches of adjacent plates align so long as a fold 38B of one plate aligns with a fold 38A of its neighboring plate. If the folds 38A and the folds 38B had identical pitch, 100 percent nesting could occur between adjacent plates so as to completely close off flow passageways 36 between adjacent plates.

Although it is contemplated that as little as one notch comprising a fold 38B having a web portion 60 having a reversed pitch is necessary per sheet to preclude nesting between adjacent sheets, it is preferred that a fold 38B having a reversed pitch be disposed a periodic intervals between folds 38A which would constitute the majority of folds in a sheet. It is presently contemplated that having every third, fourth or fifth fold comprise a fold 38B, with the remaining intervening folds comprising folds 38A, would virtually ensure the preclusion of nesting between adjacent heat transfer sheets in any element stack. Of course, forming folds 38B between folds 38A at sequential positions of non-uniform spacing is also plausible. For example, forming the spacing notches in each sheet 32 such that the second, the fifth, and the tenth notches in any sequence of ten notches in each sheet comprise folds 38B while remaining notches in that sequence of ten notches comprise folds 38A would also virtually preclude nesting between adjacent heat transfer element sheets in any stacked array.

It is contemplated that the heat transfer element sheets 32 would be cut from a continuous sheet of notched material and assembled in an element basket frame in accordance with customary practices in the industry. One method for manufacturing heat transfer element sheets for stacking in an array to form an assembly of heat transfer element sheets for disposing in an element basket for a rotary regenerative heat exchanger which has particular applicability for manufacturing the heat transfer element sheets 32 suitable for forming a heat transfer element assembly 30 in accordance with the present invention is disclosed in U.S. Pat. No. 4,553,458, the disclosure of which is hereby incorporated by reference.

As disclosed therein, the individual heat transfer element sheets are cut from a continuous sheet of heat transfer element material for subsequent assembling within an element basket disposed at the end of the assembly line. To begin the manufacturing process, a continuous sheet of the particular heat transfer element material from which the individual element sheets are to be cut is drawn from a material roll and passed under forming presses which impart to the continuous sheet any desired surface configuration, most commonly a continuous, shallow wave-like corrugation or undulation, and form the required spacing notches at spaced intervals along the continuous sheet. In manufacturing, the heat transfer elements sheets 32 of the present invention, the notching roll would be adapted to provide the desired number of folds 38B having web portion of reversed pitch in the desired positions in a sequence of a given number of notches as hereinbefore discussed. Each revolution of the notching roll would form the desired notching pattern in a continuous manner and the desired notching pattern would be continuously repeated as the notching roll completes each revolution.

As discussed in greater detail in U.S. Pat. No. 4,553,458, the cutting process is controlled through continuously monitoring the position of an upstream notch relative to the line along which the shears cut the leading edges of the element subsheets so that an offset of at least a preselected minimum amount is always maintained between notches of sequenctially cut element subsheets. The leading edge of the first subsheet is cut along a first line and the position of a particular upstream notch, for instance, the first upstream notch, relative to the first line along with the leading edge was cut is detected and stored. The material is then advanced by an amount equal to the desired length of the first subsheet and a trailing edge is cut along a second line. The position of the upstream notch in the next subsheet to be cut, corresponding to the particular upstream notch in the subsheet just cut, relative to the second line along which the trailing edge is cut is then detected. The difference in the distances of the two detected notches from their respective reference lines is then calculated and compared to a preselected minimum tolerance indicative of the least acceptable offset between notches of neighboring element subsheets to ensure that the notches of successive sheets are not aligned when the sheets are stacked one atop another in an element basket at the end of the assembly line, but rather are offset from each other as shown in FIGS. 2, 3 and 4.

While the heat transfer element assembly 30 has been shown and described embodied in a rotary regenerative heat exchanger, it will be appreciated by those skilled in the art that the heat transfer element assembly of the present invention can be utilized in a number of other heat exchange apparatus not only of the regenerative type but also of the recuperative type. Additionally, various plate configurations, some of which have been alluded to herein, may be readily incorporated into the heat transfer element assembly of the present invention by those skilled in the art. We, therefore, intend by the appended claims to cover the modifications alluded to herein as well as all other modifications which may fall within the true spirit and scope of the present invention.

I claim:

1. An assembly of heat transfer element for a heat exchanger comprising a plurality of heat transfer plates stacked in spaced relationship thereby providing a plurality of passageways between adjacent plates for flowing a heat exchange fluid therebetween, each of said plates having spacers formed therein at spaced intervals so as to maintain a predetermined distance between adjacent plates, said spacers comprising bilobed folds having first and second lobes projecting outwardly from the plates, each lobe having an outermost surface for contacting an adjacent plate, and a sloping web portion extending between the outermost surface of the first and second lobes, a first portion of said folds in each of said plates having their first lobe projecting outwardly from said plate in a first direction and their second lobe projecting outwardly from said plate in a second direction opposite to the first direction, and a second portion of said folds in said plate having their first lobe projecting outwardly from said plate in the second direction and their second lobe projecting outwardly from said plate in the first direction, the web portions of said second portion of said folds thereby having a pitch opposite to the pitch of the web portions of said first portion of said folds, said bilobed folds being formed in each plate at equally spaced intervals along the length thereof, each fold disposed at a periodic interval equal to at least three-times the spaced interval comprising a fold from said second portion of said folds and each fold disposed between said spaced second folds comprising a fold from said first portion of said folds, said first portion of said folds, comprising at least one-half of the total number of folds in said plate and said second portion of said folds comprising no more than one-half of the total number of folds in said plate.

2. A heat transfer element assembly as recited in claim 1 wherein said first and second lobes of the bilobed folds in said plates comprise substantially V-shaped grooves having the apex of the V directed outwardly from said plate.

3. A heat transfer element assembly as recited in claim 2 wherein said heat transfer plates are undulated.

4. A heat transfer element assembly as recited in claim 1 wherein said first and second lobes of the bilobed folds in said plates comprise substantially U-shaped grooves having the apex of the U directed outwardly from said plate.

5. A heat transfer element assembly as recited in claim 4 wherein said heat transfer plates are undulated.

6. A heat transfer element assembly as recited in claim 1 wherein said plates are alternately stacked such that the folds in each of said plates are disposed between the folds of its adjacent plates.

7. A heat transfer element assembly as recited in claim 6 wherein said plates are undulated.

8. A heat transfer element assembly as recited in claim 1 wherein said plates are undulated.

9. A heat transfer plate adapted for stacking in spaced relationship with like heat transfer plates in a support frame to form an element basket for use in a rotary heat exchanger, said heat transfer plate comprising a length of sheet having outwardly protruding spacing notches formed therein at space intervals along the length of said sheet, said notches comprising bilobed folds having first and second lobes projecting outwardly from the sheet, each lobe having an outermost surface and a sloping web portion extending between the outermost surfaces of the first and second lobes, a first portion of said folds in said sheet having their first lobe projecting outwardly from said sheet in a first direction and their second lobe projecting outwardly from said sheet in a second direction opposite to the first direction, and a second portion of said folds in said plate having their first lobe projecting outwardly from said sheet in the second direction and their second lobe projecting outwardly from said sheet in the first direction, the web portions of said second portion of said folds thereby having a pitch opposite to the pitch of the web portions of said first portion of said folds, said bilobed folds being formed in said sheet at equally spaced intervals along the length thereof and each fold disposed at a periodic interval equal to at least three-times the spaced interval comprising a fold from said section portion of said folds and each fold disposed between said spaced second folds comprising a fold from said second portion of said folds, said first portion of said folds comprising at least one-half of the total number of folds in said sheet and said second portion of said folds comprising no more than one-half of the total number of folds in said sheet.

10. A heat transfer plate as recited in claim 9 wherein said first and second lobes of the bilobed folds in said sheet comprise substantially V-shaped grooves having the apex of the V directed outwardly from said sheet.

11. A heat transfer plate as recited in claim 10 wherein said sheet is undulated.

12. A heat transfer plate as recited in claim 9 wherein said first and second lobes of the bilobed folds in said sheet comprise substantially U-shaped grooves having the apex of the U directed outwardly from said sheet.

13. A heat transfer plate as recited in claim 12 wherein said sheet is undulated.

14. A heat transfer plate as recited in claim 9 wherein said sheet is undulated.

* * * * *